United States Patent [19]

Schapiro et al.

[11] Patent Number: 4,618,346

[45] Date of Patent: Oct. 21, 1986

[54] DEASHING PROCESS FOR COAL

[75] Inventors: Norman Schapiro, Sudbury; Eugene J. Moreau, Waltham, both of Mass.

[73] Assignee: Resource Engineering Incorporated, Waltham, Mass.

[21] Appl. No.: 654,498

[22] Filed: Sep. 26, 1984

[51] Int. Cl.[4] ..... C10L 1/00

[52] U.S. Cl. ..... 44/1 A; 44/1 SR

[58] Field of Search ..... 44/1 A, 1 SR

[56] References Cited

U.S. PATENT DOCUMENTS

| | | | |
|---|---|---|---|
| 4,054,421 | 10/1977 | Robinson et al. | 44/1 SR |
| 4,083,940 | 4/1978 | Das | 44/1 SR |
| 4,169,710 | 10/1979 | Jensen | 44/1 SR |
| 4,192,651 | 3/1980 | Keller | 44/1 SR |
| 4,233,034 | 11/1980 | Miller et al. | 44/1 SR |
| 4,305,726 | 12/1981 | Brown, Jr. | 44/1 SR |
| 4,328,002 | 5/1982 | Bender | 44/1 SR |
| 4,334,888 | 6/1982 | Corcorun et al. | 44/1 SR |
| 4,364,740 | 12/1982 | Massey et al. | 44/1 SR |
| 4,401,550 | 8/1983 | Urbon | 44/1 SR |
| 4,408,999 | 10/1983 | Karni et al. | 44/1 SR |
| 4,424,062 | 1/1984 | Kamino et al. | 44/1 SR |
| 4,441,886 | 4/1984 | Muchmore et al. | 44/1 SR |
| 4,476,012 | 10/1984 | Gatsis | 44/1 A |

*Primary Examiner*—Andrew H. Metz
*Assistant Examiner*—Helane Myers
*Attorney, Agent, or Firm*—Pahl, Lorusso & Loud

[57] ABSTRACT

A process for reducing ash content of coal with an initial concentration of inherent ash of approximately 0.25 w/o to approximately 3 w/o. The coal is swollen and wetted with an alcohol solution such as methanol, then deashed with a mineral acid solution such as hydrochloric and hydrofluoric acid. The demineralized coal is neutralized, washed, and dried for use in making coal slurries with a very low ash content.

14 Claims, 1 Drawing Figure

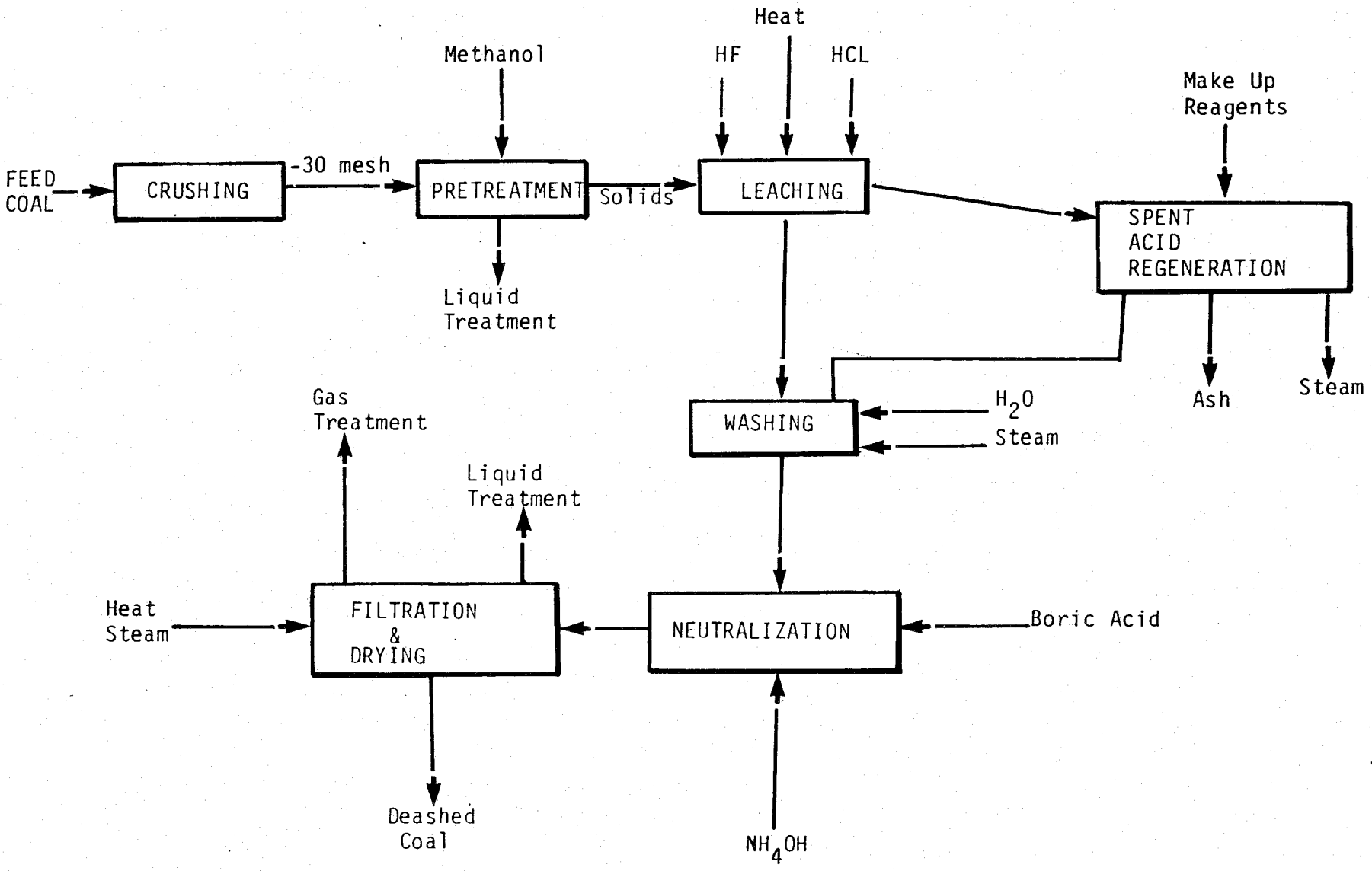
FEED COAL
CRUSHING
-30 mesh
Methanol
PRETREATMENT
Solids
Liquid Treatment
Heat
HF
HCL
LEACHING
Make Up Reagents
SPENT ACID REGENERATION
Steam
Ash
WASHING
$H_2O$
Steam
Boric Acid
NEUTRALIZATION
$NH_4OH$
FILTRATION & DRYING
Liquid Treatment
Gas Treatment
Deashed Coal
Heat
Steam

DEASHING PROCESS FOR COAL

BACKGROUND OF THE INVENTION

Coal is not a uniform substance but rather a mixture of combustible, metamorphic plant remains that varies in both physical and chemical composition. Ash producing substance, sulfur, and other materials may be present in amounts as high as sixty percent.

Coal ash is the residue resulting from non-combustible acidic and basic components in the coal. The major acidic components are $SiO_2$ and $Al_2O_3$. Basic components include magnesium oxide, calcium oxide, sodium oxide, potassium oxide, and hematite ($Fe_2O_3$). Acidic components include phosphates and sulfates.

Three types of deposits form in coal fired boilers as a result of burning coal: fusion type deposits, alkali matrix deposits, and phosphatic deposits.

Fusion type deposits are the most common. They result from fusion and adhesion of fly ash to the components of the boiler. The chemical composition is a result of starting coal ash. If particle to particle adherence is weak, buildup will be limited to thin layers. A liquid phase, if present, is more likely to adhere than a solid phase, so low melting point components greatly accentuate deposit buildup.

Alkali matrix or bonded deposits form on superheater or generator tube sections and often limit boiler capacity. Alkali metal sulfates, such as $Na_2SO_4$ and $K_2SO_4$, act to cement fly ash to the metal surfaces.

Phosphatic deposits are uncommon as phosphorous is seldom found in coals, other than as additives. They cause an acidic attack on the metal and heavy fouling.

Sulfur is usually present in coal as inorganic combinations such as pyrite or marcasite or calcium sulfate. The three major forms are organic, pyritic, or sulfate sulfurs.

In almost all cases, it is desirable to clean coal of the majority of the ash and sulfur and other foreign matter prior to transporting and burning the coal. The reasons for doing so include environmental factors such as the contamination of the air and the furnace by pollutants, economic considerations such as the cost of hauling unusable material over extended distances and the elimination of the need for the extremely expensive refitting of coal plants with emission controls, and limitations on the amount of foreign materials which can be tolerated in the process in which the coal is to be used. These savings must be balanced against the cost of cleaning the coal.

Traditionally most coal has been cleaned by crushing and washing with water. Another method is flotation. Flotation processes impart hydrophobic properties to the sulfur and other impurities in crushed coal so that when air is bubbled through the coal suspension, the coal floats to the top. Much work has been done in the area of flotation separation, as shown in U.S. Pat. No. 4,173,530 to Smith et al. Disadvantages and problems associated with flotation separations include limitations on the size of the coal which can be processed, use of specific flotation solutions, poor separations, and fouling of the separation fluids which must then be replaced.

Other cleaning techniques include gravity separations using centrifugal apparatus, such as the methods disclosed in U.S. Pat. Nos. 2,842,319 and 3,908,912; solvent extractions; and combinations of mechanical and chemical separations. Examples of processes in which the coal particles are coated with separation enhancing chemicals are disclosed in U.S. Pat. Nos. 3,852,182 and 3,856,675, which teach coating liquified coal with aromatic compounds such as anthracene, naphthalene or benzene; and U.S. Pat. No. 2,346,151 which discloses slurried coal mixed with an acidic wetting and frothing agent and an antioxidant for separation.

A number of methods have been developed to chemically extract minerals from coal such as is disclosed in U.S. Pat. Nos. 4,045,092 and 4,055,400. The '400 method uses heated alkali solutions to leach out pyritic, organic, sulfur and ash components. The '092 method involves adding calcium hydroxide to fix sulfur in a methanol-coal slurry. Methanol slurries have become relatively widely used. Methanol has certain advantages over both oil and water in transporting micronized coal. Articles describing alkali extraction of methanol treated coal include "Solvolysis Extraction of Assam Coal", *Indian Journal of Technology,* 20: 235–236 (1982) and "Alkali Treatment of Coal", *India Engineering and Chemical Products Resource Development,* 22: 488–491 (1983).

Leaching of minerals from coal by an acid has also been used. See "The Effect of Acid Treatment on Dilatometric Properties of Coal", Fuel, 62(1); 5–9 (1983) and "Products of the Treatment of Fusinitic Brown Coals with Mineral Acids and Of Extractions with Ethanol-Benzene", *Solid Fuel Chemistry,* 16(2): 5–9 (1982).

These processes have failed to combine both commercial feasibility and ash yields of less than 1 w/o. In addition, most cleaning processes alter the combustibility, handling properties and surface chemistry characteristic from that of the starting coal.

It is therefore an object of the present invention to provide a process for deashing coal that is economically and technologically practical.

It is a further object of the present invention to provide a process that yields coal with an ash content of less than one weight percent.

It is a still further object of the present invention to provide a coal with combustibility, manageability and surface chemistry characteristics which are substantially the same as those of the starting material.

It is yet another object of the invention to provide a process for the deashing of coal in which the reagents may be recovered and reused.

SUMMARY OF THE INVENTION

The present invention is a process for removing ash producing components and inorganic materials from coal. The primary features of the process are the treatment of the coal with an alcohol containing 1 to 4 carbons, such as methanol, to enhance the wettability of the coal surface and to open up the pores in the coal, and extraction of the inorganic materials using mineral acids such as hydrochloric and hydrofluoric acids.

The residual acid in the demineralized coal is removed by washing with water. The acid may optionally be neutralized with ammonium hydroxide or boric acid or other basic compounds prior to removal by water. The cleaned coal is filtered, dried, and processed for use in gas or liquid treatment processing or coal slurries.

BRIEF DESCRIPTION OF THE DRAWINGS

The sole FIGURE of the drawing is a schematic diagram of the process of the present invention.

DETAILED DESCRIPTION OF THE PREFERRED EMBODIMENT

As shown in FIG. 1, the process of the present invention consists of:

1. crushing the feed coal to the preferred particle size;
2. swelling the sized coal with methanol or other alcohols;
3. demineralization of the swollen coal with mineral acids such as hydrochloric and hydrofluoric acids;
4. removal and regeneration of the acids;
5. neutralization and washing of the demineralized coal; and
6. filtration and drying of the washed, deashed coal.

The swelling and demineralized steps may be performed sequentially or simultaneously. The acid leaching solution may be heated to speed up the mineral dissolution. Neutralization may be by addition of ammonium hydroxide or boric acid to the wash solution or simply by multiple washings with water. The washed, dried, deashed coal may be micronized to 10 to 20 micron particle size to facilitate formation of a slurry.

Comminuted or crushed coal is used in the preferred embodiment. The preferred size coal to be treated is a function of the coal rank. For example, −30 mesh and −45 mesh are the preferred sizes for subbituminous and bituminous coal, respectively. The particle size may range, however, between −30 mesh and −45 mesh down to −100 mesh. The lower limit is determined by the handling problems associated with acid treatment of smaller particles.

Ash, as determined in coal analysis, may be defined as the noncombustible residue that remains when coal is burned. It does not occur as such in coal, but is formed as the result of chemical changes that take place in the mineral matter during the ashing process.

The ash-forming materials occurring in coal are of two kinds: extraneous mineral matter and inherent ash. The extraneous mineral matter is composed mainly of clay and shale minerals, calcite, pyrite or marcasite and lesser chloride and fluoride minerals. Inherent ash includes inorganic elements combined with the organic part of the coal, the origin of which is the plant material from which the coal was formed. Inherent ash displays a reasonably uniform, essentially molecular distribution throughout the coal mass. Inherent ash seldom exceeds 2 or 3 percent of the weight of the coal. The lower the inherent ash in the coal, the more reasonable of a reduction in the ash can be expected.

An alcohol solution containing between one and four carbons is added to the coal to enhance mineral removal by the subsequent acid treatment. Methanol is the preferred alcohol. The methanol acts both by swelling the pores and by wetting the surface of the coal. By swelling of the pores, the coal is made more permeable so that the acid solution penetrates more completely into the coal to dissolve the mineral matter. The increased wetting properties of the coal facilitates the reaction of the acid with the ash particles.

Methanol can be added to the coal prior to the acid solution treatment, or it can be mixed with the acid solution. If used as a pretreatment solution, the methanol is preferably added in a ratio of 5 ml. methanol per 50 grams coal. 10% of the aqueous acid is added, the coal is mixed to form a smooth paste, then the remainder of the acid is added. The acid is added to a final concentration of between 12.5% and 50% solids. The methanol may also be mixed with the acid solution in a concentration of 0.3 to 1.2% of the acid.

The selection of acids used to demineralize coal depends on the type of mineral matter and "inherent ash" present in the coal. Dilute hydrochloric acid and hydrofluoric acid can be used separately or in combination. Separately, these acids are effective at a concentration of from 1 to 10 percent. Various combinations have been effective. For example, a combination of 2.5 percent hydrochloric acid and 2.5 percent hydrofluoric acid has been the preferred acid mix in treating Southern West Virginia bituminous coal. Acid concentrations in the range of 0.1 to 10N can be used. 0.5 to 2N is preferred, however.

Some of the reactions that leach minerals from the coal are as follows:

| |
|---|
| $4HF + SiO_2 \rightarrow SiF_4 + 2H_2O$ |
| $2FeS_2 + 8HCl \rightarrow 2FeCl_2 + 4H_2S + 2Cl_2$ (pyrite) |
| $CaCO_3 + 2HCl \rightarrow CaCl_2 + CO_2 + H_2O$ (calcite) |
| $K_2O + 2HCl \rightarrow 2KCl + H_2O$ |
| $6HF + Al_2O_3 \rightarrow 2AlF_3 + 3H_2O$ (major component of clay minerals) |

The rate of dissolution of the mineral matter (ash) is a function of:

1. type of mineral matter
2. percentage of mineral matter
3. porosity of coal
4. rank of coal
5. size of coal
6. reagents used for dissolution
7. time of dissolution
8. temperature The acid reaction is effective under ambient conditions. Heating the coal solution to 80°–100° C. may be used to speed up the acid dissolution of the mineral matter, if desired.

As an example to show relative rates of dissolution of minerals by acid when heated and not heated, about $\frac{2}{3}$ to $\frac{1}{2}$ of the ash content of −45 mesh×0 coal with 2% ash is removed within 24 hours of acid treatment. With occasional stirring of the acid solution, slow leaching continues until an additional $\frac{1}{3}$ of the ash has been removed at the end of 60 hours. The original 2% of the ash is therefore reduced to 0.7% ash within 24 hours, and to 0.43% ash at the end of 60 hours. Not all minerals dissolve at the same rate. A slow rate of ash reduction will continue theoretically until only those minerals which do not go into the solution remain. Heating to between 80° and 100° C. increases the rate of dissolution by a factor of three.

After acid leaching has produced the desired level of ash, the acid solution is removed by filtration and the acid regenerated by known processes such as steam stripping. Alternatively, the remaining unreacted acid is complexed. For example, boric acid complexes any unreacted hydrofluoric acid to render the deashed coal non-corrosive. The boric acid is preferably a saturated solution (6.5 percent at ambient temperature or 20 percent when heated), with the ambient temperature solution being preferred. Ammonium hydroxide is then used to neutralize any unreacted hydrochloric or hydrofluoric acid according to the following reaction:

$$2NH_4OH + HCl + HF \rightarrow NH_4Cl + NH_4F + 2H_2O$$

The coal is then washed with water and filtered. The washing step is repeated three to six times until the filtrate no longer shows any trace of chlorides.

The coal is filter pressed from about 45% moisture to 12% moisture, then thermally dried to approximately 2% to 5% moisture. The dried coal may be micronized, e.g. in a fluid energy mill, to an average size range of 10–20 microns and slurried with distilled water and a nonionic surfactant to produce a coal water slurry of less than 0.3% ash at 50% dilution.

EXAMPLE 1

A Virginia high volatile A bituminous coal was selected for deashing. This coal contained a low inherent ash (1 percent) and a high silica content ash, which made this coal amenable for acid leaching in order to produce a coal of 0.4 percent ash or less. The deashed coal was to be used in a coal water slurry.

The original ash content of the coal used in this experiment contained 35 percent ash. This coal was beneficiated by conventional physical coal cleaning methods and the ash was reduced to 3.1 percent.

The 3.1 percent ash coal was crushed to minus 30 mesh, then wetted using methanol in a ratio of 5 ml. methanol per 50 grams coal. An acid solution consisting of 2.5 percent dilute hydrochloric acid, 2.5 percent dilute hydrofluoric acid and 95 percent water was added to the wetted coal to form a concentration of 50% solids by initially adding ten percent of the acid solution to the coal to form a paste, then adding the remaining acid solution. The acid was reacted under ambient conditions with occasional stirring. At the end of 72 hours, the ash was reduced from 3.1 percent to 0.3 percent.

Table I lists the proximate analysis of the 3.1 percent ash coal and the 0.3% coal.

TABLE I

| | Proximate Analysis, % Dry Basis | |
|---|---|---|
| | 3.1% Ash Coal | 0.3% Ash Coal |
| Ash | 3.1 | 0.30 |
| Volatile Matter | 36.4 | 38.9 |
| Fixed Carbon | 60.5 | 60.8 |
| Btu/lb | 15,050 | 15,334 |
| Sulfur | 0.66 | 0.65 |

Table II lists the ash composition of the 3.1 percent ash coal and the 0.3% coal.

TABLE II

| | Ash Composition, % | |
|---|---|---|
| | 3.1% Ash Coal | 0.3% Ash Coal |
| $SiO_2$ | 40.3 | 22.6 |
| $Al_2O_7$ | 30.9 | 23.9 |
| $Fe_2O_7$ | 14.7 | 13.4 |
| $TiO_2$ | 1.2 | 5.9 |
| $P_2O_5$ | 0.13 | 0.6 |
| CaO | 2.7 | 10.3 |
| MgO | 1.0 | 1.2 |
| $Na_2O$ | 1.7 | 2.3 |
| $K_2O$ | 1.7 | 0.4 |
| $SO_3$ | 3.1 | 16.5 |

After acid leaching, the leached product was washed by vigorous stirring in distilled water. Any remaining acid was complexed with a saturated solution (6.5 percent) of boric acid at ambient temperatures, rendering the leached product non-corrosive. Ammonium hydroxide was then used to neutralize any remaining acid. The coal was washed three times in distilled water until filtrate showed no longer any traces of chlorides.

The leached product was then filtered pressed from 45 percent moisture to 12 percent moisture. The coal was dried further by thermal drying to 3 percent moisture.

The dried product was micronized in an air driven fluid energy mill to a size of less than 20 microns.

The micronized coal was slurried by slowly adding coal to a solution of water containing 1 percent nonionic surfactant in a large vat. The slurry was continuously stirred till all particles were wetted by the solution.

Although this invention has been described with reference to specific embodiments, it is understood that modifications and variations may occur to those skilled in the art. It is intended that all such modifications and variations be included within the scope of the appended claims.

What is claimed is:

1. A process for removing ash and sulfur from coal comprising wetting said coal with an alcohol solution sufficient to swell said coal's pores in order to optimize permeability, wherein said alcohol contains between 1 and 4 carbon atoms; and leaching said coal with a mineral acid wherein both of said wetting and leaching steps take place at a temperature less than 100° C.

2. The process according to claim 1 further comprising comminuting the coal prior to wetting with an alcohol and acid leaching.

3. The process according to claim 1 wherein the alcohol is methanol.

4. The process according to claim 3 wherein the methanol solution comprises about 5 mls. of methanol per 50 grams of coal.

5. The process according to claim 1 wherein the wetting of said coal with an alcohol and the acid leaching occur simultaneously.

6. The process according to claim 5 wherein the alcohol is methanol.

7. The process according to claim 6 wherein the mineral acid comprises 0.3 to 1.2% by weight of methanol.

8. The process according to claim 1 further comprising the step of washing the coal with water after the acid leaching step to remove the acid and leach products.

9. The process according to claim 1 further comprising the step of neutralizing the acid after the acid leaching step.

10. The process according to claim 9 wherein said neutralization is performed using a compound selected from the group consisting of ammonium hydroxide and boric acid.

11. The process according to claim 1 wherein the mineral acid is heated.

12. The process according to claim 1 further comprising collecting and regenerating the mineral acid after the acid leaching step.

13. The process according to claim 1 wherein said mineral acid is selected from the group consisting of hydrochloric acid and hydrofluoric acid.

14. The process according to claim 1 wherein the coal contains less than 1% ash by weight after leaching.

* * * * *